United States Patent [19]

Tucker

[11] 4,084,337

[45] Apr. 18, 1978

[54] VISIBLE MESSAGE DISPLAY APPARATUS

[76] Inventor: Zane G. Tucker, 704 Greenbriar Way, Las Vegas, Nev. 89121

[21] Appl. No.: 638,898

[22] Filed: Dec. 8, 1975

[51] Int. Cl.[2] ..... G09F 11/28

[52] U.S. Cl. ..... 40/472

[58] Field of Search ..... 40/32, 96, 96.5; 242/71.8

[56] References Cited

U.S. PATENT DOCUMENTS

| | | | |
|---|---|---|---|
| 2,097,148 | 10/1937 | Erlandsen | 40/32 |
| 2,540,469 | 2/1951 | Archey | 40/32 |
| 3,617,010 | 11/1971 | Coy | 242/71.8 X |
| 3,724,771 | 4/1973 | Zielke | 242/71.8 X |
| 3,753,533 | 8/1973 | Lyman | 242/71.8 X |
| 3,917,186 | 11/1975 | Solomon | 242/71.8 |

FOREIGN PATENT DOCUMENTS

| | | | |
|---|---|---|---|
| 255,968 | 8/1926 | United Kingdom | 40/32 |

*Primary Examiner*—Louis G. Mancene
*Assistant Examiner*—Wenceslao J. Contreras
*Attorney, Agent, or Firm*—Seiler & Quirk

[57] ABSTRACT

Apparatus for continuously displaying a visible message comprises a case for housing the components having a window or port through which the message is displayed, a storage reel for continuously taking up and playing out a continuous tape having a visible message thereon and a drive means for driving the tape from the reel, past the window, and back onto the reel.

2 Claims, 4 Drawing Figures

VISIBLE MESSAGE DISPLAY APPARATUS

BACKGROUND OF THE INVENTION

Continuous display signs, and especially those which can be operated in rather confined areas or in commercial vehicles such as limousines, buses and taxi cabs are extremely useful for conveying information to customers and passengers. Especially useful is a compact, portable and relatively simple apparatus for continuously displaying messages, advertisements and the like as disclosed in U.S. Pat. No. 2,608,778. However, a significant problem with such a device is the use of a pleated or folded band which frequently malfunctions as the tape continually folded and unfolded as it is directed through the apparatus. It is to the elimination of such problems that the present invention is directed.

SUMMARY OF THE INVENTION

The present invention provides a compact, simple and extremely efficient device for visibly displaying information or advertisements. The apparatus incorporates a storage reel for continuously taking up and playing out a continuous tape on which a message is present. The apparatus is also designed to prevent tape from unwinding off of the reel except at the playout position. A simple drive means and idler assembly is incorporated as are guide members for directing the tape from and to the reels. The reel is also provided with means for winding the tape initially without regard to tension after which tabs are removed whereby the tape will be automatically wound on the reel at the proper tension without interfering or affecting continuous operation. These advantages as well as others and characteristics of the apparatus will be evident from the following detailed description.

DETAILED DESCRIPTION OF THE INVENTION

Figure 1:
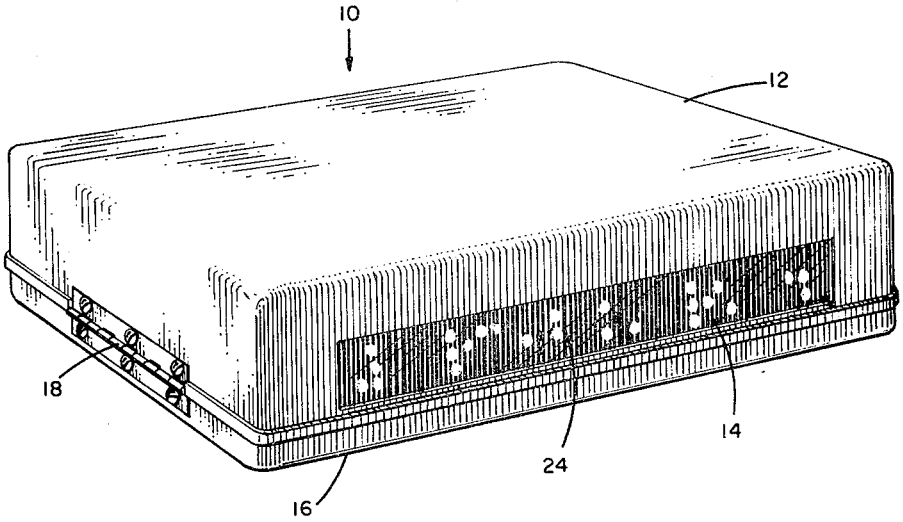
FIG. 1 is a perspective view of the exterior of the apparatus showing the case.

FIG. 1 shows the exterior of the apparatus case 10 having an upper or lid portion 12 and a base portion 16 with hinge 18 connecting the two. The case includes a window 14 through which lettering, figures or other indicia on the tape are exposed.

Figure 2:
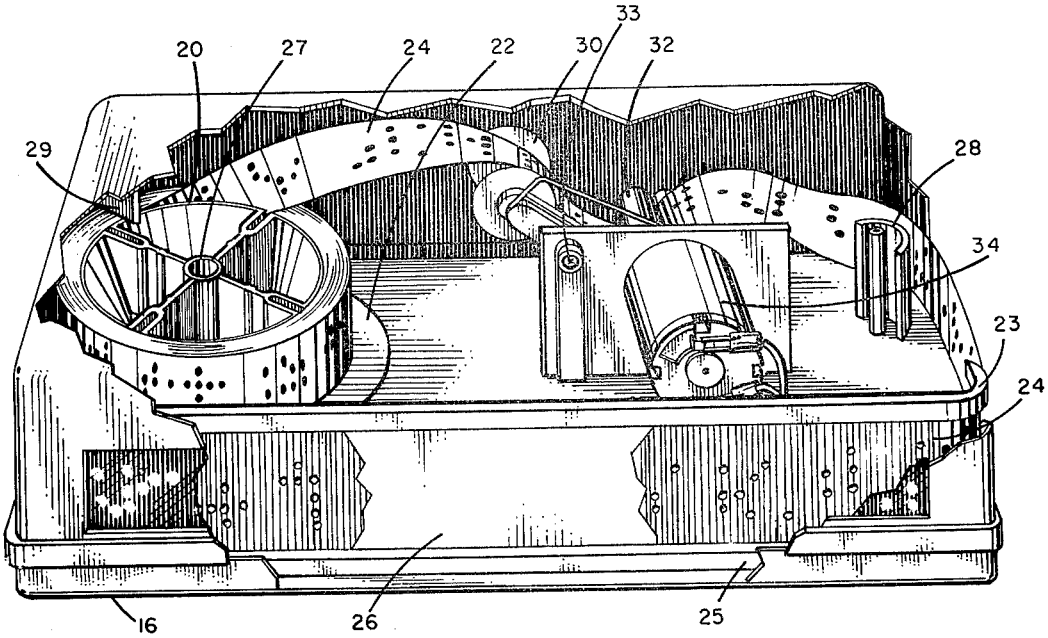
FIG. 2 is a front view of the exposed components of the apparatus of the invention with the case partially cut away.
Figure 3:
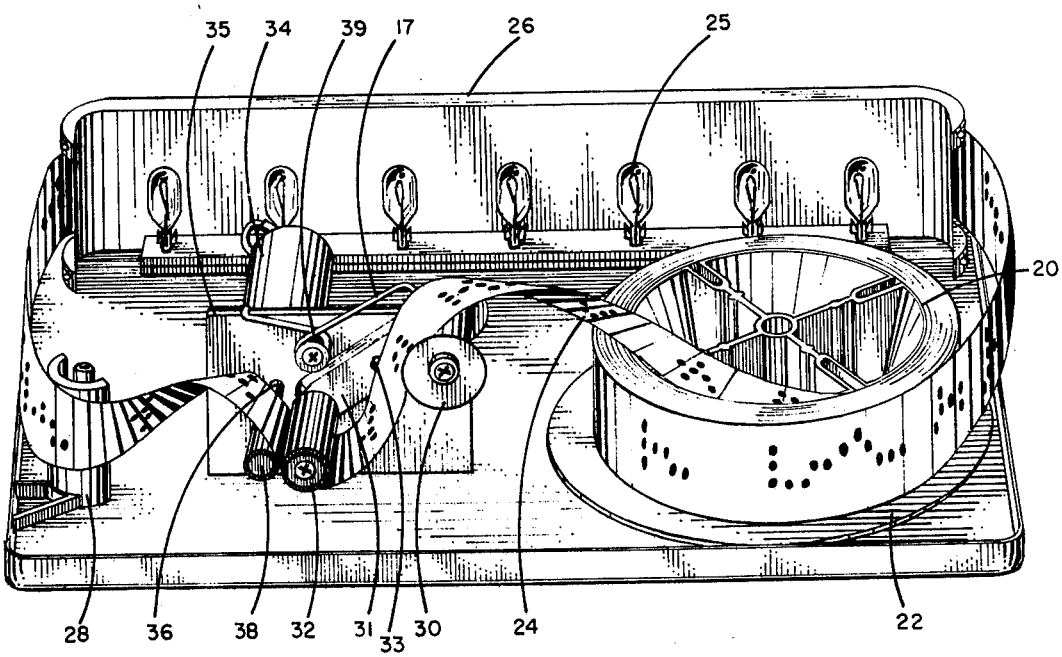
FIG. 3 is a back view of the exposed components.

Observing FIGS. 2 and 3, a tape 24 which is a continuous or endless band is played out and rewound on reel 20. The tape is directed past guide members 28 and 26, the latter elongated and acting as a back support along which the tape travels while being exposed through window 14. The figures show the interior components which are attached or secured on bottom case portion 16. Reel 20 is mounted for rotatable movement about a substantially vertical axis. Preferably, the reel itself is not driven so that its rotating motion occurs as tape 24 is pulled out of and directed back to the reel in a continuous winding and unwinding operation. A simple, efficient and preferred way of mounting the reel in the case is to utilize a peg or shaft on the interior bottom surface of case portion 16 and simply mount the reel on the peg. A hollow shaft 27, having a diameter at least slightly greater than that of the peg, will be useful for this purpose. This feature will prevent binding or undue friction of the reel as it rotates on the peg. However, if desired, the peg may be provided with a bearing sleeve or other journaled member for reducing friction and which will assist in enhancing the rotation of the reel. Moreover, the reel may also be easily removed by simply lifting it from the peg for replacement with a tape with different messages. Accordingly, the reel should be attached so that it can be easily removed and replaced, for ease in substituting different messages as desired as well as in repairing and servicing the device.

The tape is driven to and from the reel by a motor 34, preferably electrically powered with motor drive shaft 36 turning drive roller 38. A small 12 volt D.C. motor is suitable and may be single or variable speed, depending on the rate of tape advance desired.

The apparatus also preferably includes an idler assembly comprising first and second idler rollers 30 and 32 respectively. As tape 24 leaves reel 20, it passes over first idler roller 30 and then under second roller 32 and over drive roller 38. The first and second idler rollers are connected to a common pivot arm 31 which pivots about rod 33 secured on plate 35. Accordingly, the idler rollers cooperate to maintain proper tension of tape 24 and at the same time assist in driving or urging the tape through the apparatus during operation. In the preferred embodiment shown, first roller 30 is elevated somewhat from the upper edge of the wound tape on reel 20. This first roller elevation provides adequate clearance for the tape as it is played out from the inner convolution. A spring 17 urges roller 30 downwardly and concomitantly roller 32 upwardly so that the latter is urged towards drive roller 38. Since the tape passes between idler roller 32 and drive roller 38, the bias of the idler roller urges the tape against roller 38 whereby frictional engagement of the tape with the rotating drive roller causes it to be pulled from reel 20 and directed along the apparatus.

Guide members 28 and 26 are conveniently located and spaced for directing the tape from the idler assembly and drive roller past window 24 and back to reel 20. Observing particularly FIG. 2, it will be noted that guide member 26 is elongated and extends substantially across the forward portion of the apparatus, located directly behind the window 14. Upper and lower flanges 23 and 25 extend along the guide member and define a channel therealong for further guiding the moving tape. This is important, at least at the two ends of guide member 26 where the tape changes direction of about 90°, the flanges at those positions maintaining proper positioning of the tape. Such channeling and directing of the tape is important, not only to maintain it at a proper elevation with respect to window 14, through which the tape will be observed, but also so that it will be properly directed for wind up on the reel.

Figure 4:
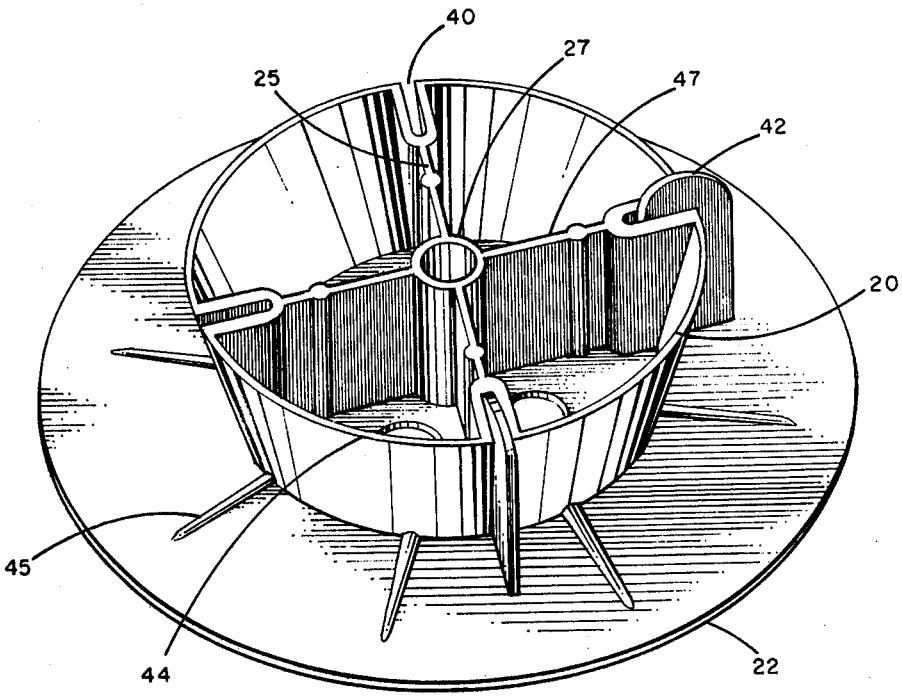
FIG. 4 is an enlarged view of the reel of the apparatus.
Figure 5:
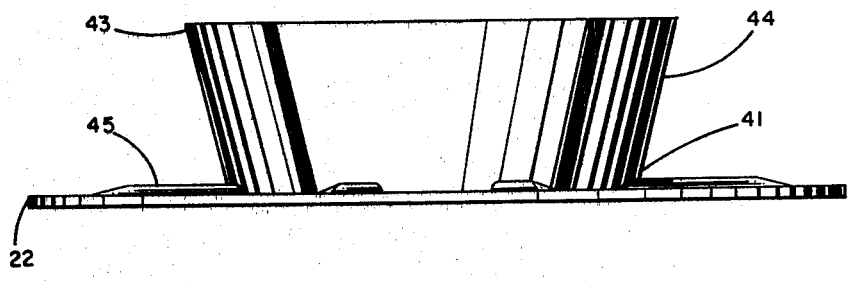
FIG. 5 is a side elevational view of the reel.

Observing FIGS. 4 and 5, there is shown in more detail reel 20 which includes a base plate 22 having an upper surface for supporting the tape as it is wound on the reel. Since the reel is designed to operate in its preferred rotation about a substantially vertical axis, the base plate will preferably have a substantially horizontal upper surface on which the bottom edge of the tape will lie. In order to reduce friction of the bottom tape surface and prevent interruption of smooth rotation of the reel, a plurality of ribs 45 may be present along a base plate upper surface. These ribs are preferably narrow, significantly reducing the area of contact between the base plate bottom tape edge. The ribs also preferably extend radially along the base plate surface and are evenly spaced.

An important improvement of the design and features of the reel illustrated are the inclined surface of the spool 44 and the use of removable tabs 42. The inclined surface preferably slants downwardly and inwardly with respect to vertical between upper and lower spool edges 43 and 41 respectively. Since the tape will be wound as illustrated in FIGS. 2 and 3 so that it stands substantially vertical on the reel, with the spool sides so slanted, and during continued wind up and play out proper tape tension is automatically achieved. The important function of the slanted spool sides is to allow the unwinding tape to be angled partially toward horizontal as it leaves the spool as shown in FIGS. 2 and 3. This unwinding tape slant avoids the necessity of a 90° tape twist (from vertical to horizontal) along the relatively short distance between the reel and roller 30. For this purpose a 20° to 45° slant of the spool from vertical is convenient. Moreover, because the upper spool edge 43 extends radially outwardly from the center of the spool to a greater extent than the lower edge 41, there is a tendency of the tape to be urged downwardly toward the base of the reel thereby resistance to unwinding off of the reel upwardly except where it is pulled out at the playout position as shown.

It is quite important for proper functioning of the apparatus to avoid the tape from becoming too tightly wound on the reel during operation. Since wind up is accomplished from the exterior or outwardly from the reel center and playout from the innermost convolution of the wrapped tape on the reel spool, if the tape becomes too tightly wound, there will be undue pressure exerted against the inner convolution thereby causing significant friction against the tape and resistance from being played out. Since the apparatus is designed so that there is no significant friction of the tape anywhere along its path as it travels to and from the reel except between idler and power rollers 32 and 38, undue friction on the reel will at least greatly slow the travel rate of the tape thereby causing stress on the system and possible premature motor burn out. If tape friction is greater than can be overcome by power roller 38, the tape simply will not be pulled out from the reel. Accordingly, the design of the sloping or slanting reel spool side is also intended to reduce such a problem. The preferred slant or slope of the spool sides is that of an inverted conical frustum.

To further assist in preventing undue tightening or tension of the tape, is the use of means for preventing the tape from being initially wrapped too tight prior to operation of the apparatus. Although the reel itself is designed to avoid buildup excess tension during operation, if the tape is initially wrapped too tight, it will have to be loosened before proper operation can be achieved. In order to avoid this problem, removable tabs 42 are placed around the reel when initially wrapping the tape. In the embodiment shown, four tabs 42 are placed around the spool in tab slots 40 as illustrated in FIG. 4. The specific number of tabs and slots utilized is not so critical so long as the spacing between the tabs is generally uniform. Preferably the reel is designed so that at least three tabs may be used, generally equally spaced from one another around the exterior peripheral surface of the spool. The device shown utilizes four which is quite adequate. Moreover, the tab slots are conveniently located at the ends of braces or ribs 47. Prior to initially wrapping the tape on to the spool, the operator will insert tabs 42 into the tab slots. Thereafter, the tape will be wrapped in successive convolutions utilizing the outer tab edges as the surface against which the flat tape is wrapped. When the tape has been substantially completely wrapped, the tabs are removed and the tape is threaded around its path in the apparatus. Once this is accomplished, the device is ready for operation. Again, the reel is designed so that automatic take up with the proper slack or tensioning of the tape occurs, assisted by the idler rollers.

As previously described, the idler assembly may also include a spring for assisting in maintaining roller 32 biased towards power roller 38. However, this spring should be one that will not cause undue pressure of roller 32 against roller 38 which could cause binding of the tape at that location and slow down or stoppage of the device. Although power roller 38 as previously described is one having a surface for frictionally engaging the tape passing thereover thereby advancing it with the assist of idler roller 32, instead, a sprocket wheel may be used in cooperation with the tape having sprocket orifices on the side, much like photographic film. However, the invention is not to be so limited and other equivalent means of advancing the tape may be used.

Observing again FIG. 2, there is also preferably provided a projection 29 secured to the interior of lid portion 12 of the case. The purpose for this is to have a surface which lies close to the upper edge of the tape wrapped on the spool in order to prevent the tape from becoming unwound so that playout can occur only at the proper position when the lid is down with the case closed. However, other equivalent means may be used such as arms and the like, preferably movable or retractable so that the reel can be replaced easily.

FIG. 3 also illustrates a plurality of lights 25 located behind guide member 26. The guide member is preferably translucent so that the light from the bulbs or other source of illumination will back light for the tape as it passes in front of the guide member. The tape itself may be opaque and provided with perforations forming letters to achieve the desired message to be visibly conveyed to the observer. Alternatively, the tape may be translucent with figures or art work thereon to be observed. Other modifications of the apparatus described herein to achieve the same function within the purview of the invention will be evident to those skilled in the art.

I claim:

1. In an apparatus for continuously displaying a visible message including a case member for housing components and having a window through which said message is displayed, a continuous tape having said message thereon for being viewed through said window, the improvement comprising:

a drop-in storage reel on which said tape is wound for being continuously taken up and played out, said reel including removable tab members against which said tape is initially wound on said reel without regard to tension, and drive means for engaging and driving said tape independent of said storage reel.

2. In an apparatus for continuously displaying a visible message including a case member for housing components and having a window through which said message is displayed, a continuous tape having said message thereon for being viewed through said window, the improvement comprising:

a drop-in storage reel on which said tape is wound for being continuously taken up and played out, and drive means for engaging and driving said tape independent of said storage reel, wherein said case member has a cover having means for preventing said tape from being driven off said spool except at the playout position.

* * * * *